US007662450B2

(12) United States Patent
Bolis

(10) Patent No.: US 7,662,450 B2
(45) Date of Patent: Feb. 16, 2010

(54) ORNAMENTAL RIBBON AND THE PROCESS FOR ITS FORMATION

(75) Inventor: Vittorio Bolis, Ponte S. Pietro (IT)

(73) Assignee: Nastrificio Angelo Bolis S.p.A., Presezzo (Bergamo) (IT)

( * ) Notice: Subject to any disclaimer, the term of this patent is extended or adjusted under 35 U.S.C. 154(b) by 1019 days.

(21) Appl. No.: 10/475,322

(22) PCT Filed: Apr. 15, 2002

(86) PCT No.: PCT/IT02/00235

§ 371 (c)(1),
(2), (4) Date: Oct. 21, 2003

(87) PCT Pub. No.: WO02/088448

PCT Pub. Date: Nov. 7, 2002

(65) Prior Publication Data

US 2004/0131800 A1 Jul. 8, 2004

(30) Foreign Application Priority Data

Apr. 27, 2001 (IT) ..... BG2001A0012

(51) Int. Cl.
*A47G 33/04* (2006.01)
*B32B 7/02* (2006.01)

(52) U.S. Cl. ..... 428/7; 428/58; 428/212; 428/213; 428/220; 264/173.16; 264/295

(58) Field of Classification Search ..... 428/7, 428/58, 212, 213, 220; 264/173.16, 295
See application file for complete search history.

(56) References Cited

U.S. PATENT DOCUMENTS

| | | | | |
|---|---|---|---|---|
| 3,386,878 | A * | 6/1968 | Pooley | 428/318.6 |
| 4,045,270 | A * | 8/1977 | Jofs | 156/229 |
| 4,435,241 | A * | 3/1984 | Corbett | 156/244.11 |
| 5,683,778 | A * | 11/1997 | Crosier | 428/59 |
| 6,331,155 | B2 * | 12/2001 | Hanna | 493/459 |

* cited by examiner

*Primary Examiner*—David R Sample
*Assistant Examiner*—Lawrence D Ferguson
(74) *Attorney, Agent, or Firm*—Young & Thompson

(57) ABSTRACT

A ribbon used in binding and decorating includes two separate superposed flat films of polyolefin plastic, which are bonded or glued together to form an intimate union, the films differing form each other by their elastic elongaton and/or heat-shrinkage properties such that, on leaving the production equipment, the difference between the films results in a different extent of shortening between the two films, to thereby cause curving of their constituted assembly. The curving is contained within a range of elastic deformation compatible with the curvature of the subsequent winding of the ribbon and such as to create spontaneous curling of the ribbon at the ambient temperatures at which it is used, as soon as it is unwound.

10 Claims, 1 Drawing Sheet

Fig. 1
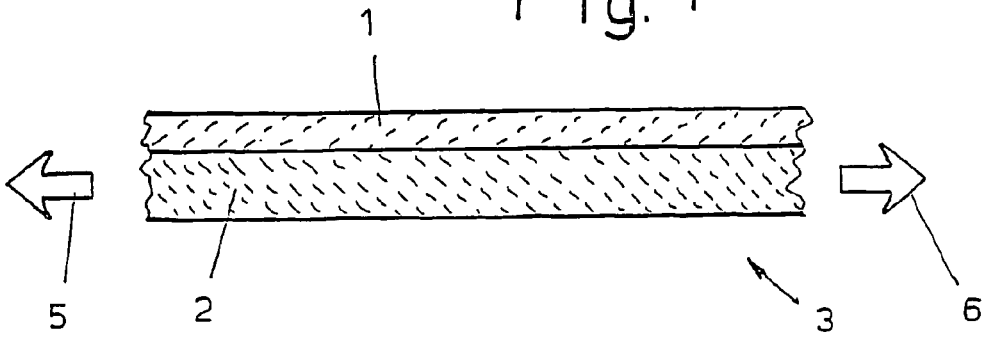
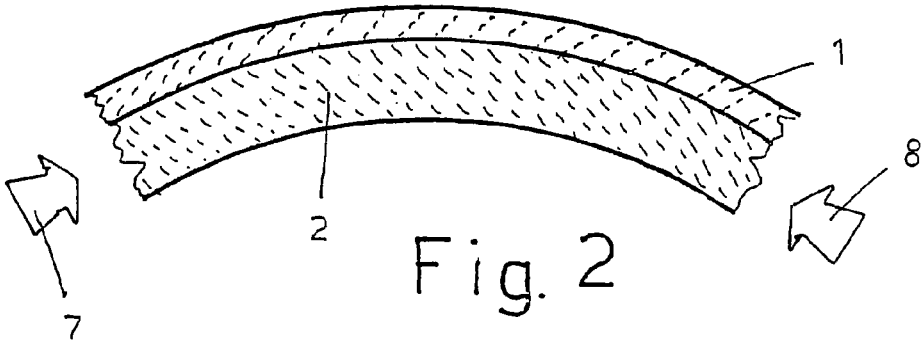
Fig. 2
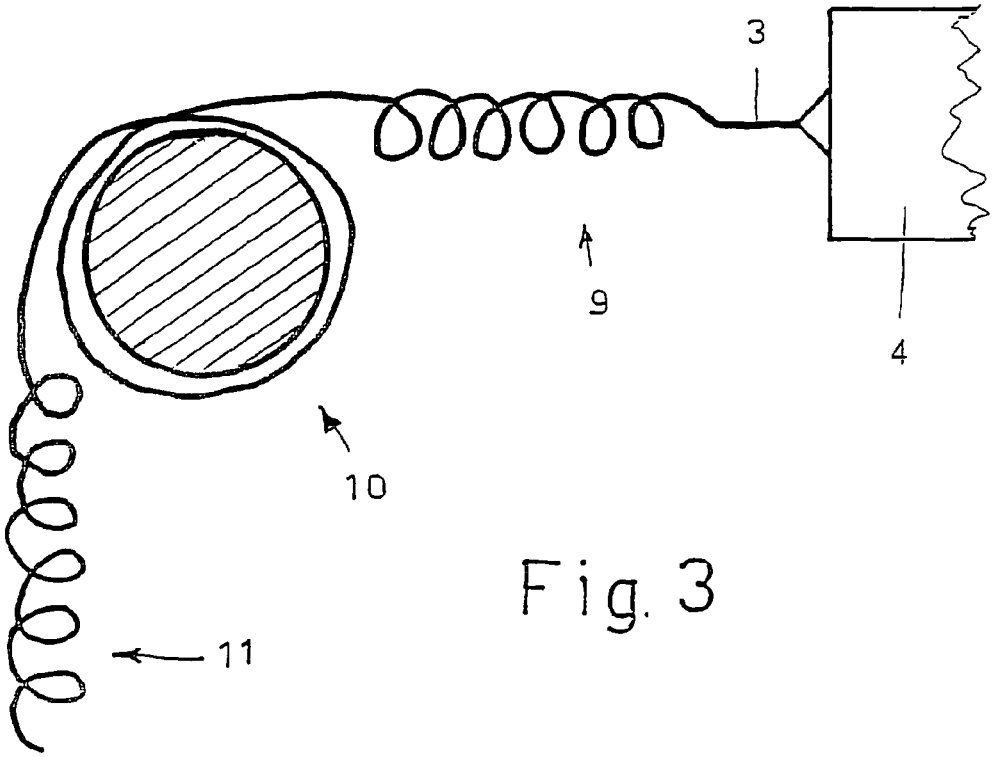
Fig. 3

ORNAMENTAL RIBBON AND THE PROCESS FOR ITS FORMATION

TECHNICAL FIELD

This invention relates to an ornamental ribbon for binding and decorating in general, which has a tendency to curl. The also relates to the process for its formation.

BACKGROUND ART

In gift presentation it is known to use decorative ribbons to secure the package wrapping, consisting of paper or other ornamental film-like material. To make the package more appealing, the end portions of the variously knotted decorative ribbon, and possibly other portions added to it to increase this appeal, are made to undergo curling or spiral winding. This curling is generally done manually by sliding the ribbon with force against a sharp edge of any implement, usually the edge of a scissors blade. The ribbons most suitable for curling are formed from one or more layers of suitable materials and/or their mixtures. Among the most used materials are plastic materials pertaining to the expanded or non-expanded polyolefin family. The principal members of this are polypropylene (PP) and polyethylene, preferably wholly of low density (PE-LD). This latter is the most sensitive to thermo-shrinkability. The said typical manual operation of curling the ends of decorative ribbons obviously requires a certain time and hence represents a cost, but in particular requires a certain expertise in judging the pressure with which the "stretching" tool should press on the ribbon and hence on the thumb which presses the ribbon during its forced sliding. The usual typical curling operation requires care to be taken in order not to ruin the fresh appearance of the ribbon and often not to cut and soil the operator's hands. The said typical operation also encounters difficulties of execution proportional to the thickness and width of the ribbon.

JP 11 020 070 and U.S. Pat. No. 5,145,725 disclose a ribbon according to the preamble of the claims. WO 93/09703 discloses a process of heat setting a ribbon formed by different layer.

An object of the present invention is to define a ribbon which can be offered to the user already provided with curls. Anther object is to define a ribbon, as above, which can be curled to provide curls of smaller radius than the normal method. Another object is to define a ribbon, as above, which can be marketed on the typical reels generally used by users. Another object is to define a ribbon, as above, which can be made of any width, in order to create new decorative applications and exclusive ornamental motifs. Another object is to define a process for forming the aforespecified ribbon.

DISCLOSURE OF THE INVENTION

These and further objects will be seen to have been attained according to the enclosed claims.

BRIEF DESCRIPTION OF DRAWINGS

The invention is illustrated by way of non-limiting example in the accompanying drawing, in which:

FIG. 1 schematically shows the thicknesses to two extended, superposed flat films joined together into an inseparable pair, and deriving their rectilinearity from an equilibrium comprising the application of a theoretical traction on the lower film to the extent sufficient to attain the theoretical rectilinearity of the upper film;

FIG. 2 shows schematically an arched configuration of the said pair of films which theoretically derives from the cessation of the traction of FIG. 1;

FIG. 3 shows, in a purely conceptual manner, a ribbon formed from a pair of arched films as indicated in FIG. 2, along a path showing respectively:

a) its exit from a forming machine (which could be a coupling device for a plurality of flat films or a die of a coextrusion unit), b) straightening resulting from its passage about a theoretical straightening cylinder of radius such as to create a straightening angle within the elastic field, c) its free exit from the aforesaid straightening passage, at which it attains the original curvature which the ribbon had before its passage about the said theoretical cylinder.

From a practical viewpoint said theoretical cylinder is identifiable with the typical reels on which the ribbon is usually sold.

The ribbon of the invention is provided with curling which could be expressed either by means of portions precut to a typical length for use, or be expressed by unwinding the end of a ribbon having a usual length of some tens of metres tightly wound on a usual cylindrical or oval reel.

BEST MODE FOR CARRYING OUT THE INVENTION

With reference to the aforesaid FIG. 1, a film 1, formed of relatively very resistant plastic material, is intimately coupled or bonded to a film 2 of relatively low resistance. What is important is a difference in strength between the two films, resulting in a difference in their percentage elongation under traction and/or in a difference in their thermal expansion, and/or in a difference in their heat-shrinkage. In this respect, from a strictly conceptual viewpoint, a production machine or plant must be provided from which there emerges a ribbon 3, formed by coupling together the two films 1 and 2, which possesses rectilinearity such as that of FIG. 1, this rectilinearity deriving from suitable thermal or dynamic conditions. An example of these conditions could be that of mechanical traction exceeding opposing forces which would cause it to curl; another example of such conditions could be that of maintaining the ribbon at such a low temperature as not to cause heat-shrinkage. In this respect, the ribbon is under such a condition as to be able to be wound on a reel 10 having a radius of curvature greater than that which it would acquire if mechanical traction is absent or if usual ambient temperature is present. As a result of this, as soon as the ribbon is unwound from its reel at normal ambient temperature, it cannot do other than assume a different geometry from that of FIG. 1, i.e. it can only curl up. To give an example clarifying the aforesaid concept, it will be assumed that the straight ribbon of FIG. 1 is formed from two films of different thermal elongation; for example the ribbon 1 may consist of polypropylene (in the limit without expansion by porosity-generating and/or endothermic agents), and the film 2 consist of polyethylene (or of a mixture of polyethylene and polypropylene).

It will also be assumed that the ribbon 3 is maintained forcibly straight during its formation within the machine 4, and at its exit therefrom, prior to being wound on the winding support at convenient temperature. On the basis of these considerations, when a given ribbon is exposed to an ambient air temperature preconsidered by production parameters to determine the required said differentiation, it will be subjected to the two different specific shrinkages of the two materials. The polyethylene will hence undergo greater shortening than the polypropylene, so that the ribbon will curve as shown in FIG. 2. A similar phenomenon could also be achieved without using the said temperature variation by assuming that the film 1 is formed of plastic material having a greater elastic modulus than the film 2. Then, as soon as traction on the ribbon, expressed by the two arrows 5 and 6 (and created for example by a winding machine), ceases, the elastic return 7-8 of the film 2 is greater than that of the film 1. Again in this case the ribbon would curve as shown in FIG. 2. On cessation of the forced straightening, the ribbon assumes a different equilibrium condition related to the lengths of the two specific films consequent on the new mechanical tension conditions involving the temperature of the two films. There is known to be a direct and reversible relationship between temperature, tension forces and elongation, i.e. that a certain elongation of a material created by a tension can reactively produce the same tension if obtained by thermal expansion. As the said ribbon consists of two different materials joined separately to each other, it will be apparent that each of them has its own specific condition of the said mechanical tension-temperature equilibrium, which interacts with the different equilibrium condition of the other material. This curved condition expressed by FIG. 2 is however a stable equilibrium condition present at the exit of the production plant 4 at any ambient temperature. Said arched structure of the ribbon of FIG. 2 is therefore mechanically deformable to an extent able to maintain it within the elastic range, in the sense that this ribbon can undergo straightening as far as angles which do not create permanent deformation within the materials, to hence leave the ribbon with its intrinsic elasticity linked to the possibility of preserving its intrinsic properties of utilization. This means that the ribbon of FIG. 2, and expressive of a required potential curling 9, can be stretched about a usual reel 10 with the usual trajectory for its winding thereon, then as soon as it is unwound from it, it assumes curling to elastically reform the shape which was previously modified by being would onto the reel 10. Advantageously, this means that the user can be provided with reels of ribbon apparently identical to the usual ones, but which instead have wound onto them a ribbon which is ready to spontaneously curl up into the required form. The invention has so far been illustrated in its conceptual aspects, because it can be implemented by usual processes modified by known methods to achieve differentiation between the two or more coupled films, to create the said differential shortening between them by utilizing their mechanical and/or thermal properties. It should again be noted that the said invention can relate to ribbons consisting of two or more layers of materials which could be different from those indicated herein, and formed by specific known production techniques. What must however be emphasised is that these techniques are modified by known methods for symmetrical and asymmetrical stretching, to achieve a new and surprising result, by the application of the aforedescribed inventive concept. The particular properties of the polyolefin plastics, namely polypropylene and polyethylene, should be noted. Following an original crystalline distribution connected with material stretch-yielding, subsequent reorganization takes place into a form facilitating subsequent molecular alignment. This stretch-yielding process is created by typical stretch-rolling during the production processes for the films from which the ribbon is produced. This molecular condition refers however to particular known tension-temperature equilibrium situations; the result is that in the absence of mechanical tensions and in the presence of high temperature (usual ambient temperature can be considered to be such) a molecular structure restoration phenomenon arises leading to a dimensional contraction of the material, commonly known as heat-shrinkage. By applying this property to the extrinsic differences existing between polypropylene and polyethylene, the resultant behaviour is well suitable for the formation of ribbons with spontaneous curling according to the present invention. Advantageously, the result obtained by coupling together two or more differently tensioned films does not mean that the user cannot apply supplementary curling as desired. For example, if curling in the form of a cylindrical spiral of five centimetres diameter derives from the effect of different coefficients of thermal expansion or of heat-shrinkage between the two coupled films for a temperature difference of 40° deriving from an exit temperature from the machine 4 of 60° and a ribbon utilization temperature of 20°, a smaller temperature difference (such as 35°) resulting from the use of the ribbon at an ambient temperature of 25° could determine a lesser heat-shrinkage between the two films, to result in curling producing a cylindrical spiral of greater diameter (such as 6 cm). If the user nevertheless desires ribbon curling as a cylindrical spiral of five centimetres diameter, he would have to supplement the curling by a curling operation similar to that generally used for curling straight ribbons. However, such an operation would be more simple or delicate, as the manual curling required would be minimal because the ribbon is already predisposed for this. Opposite situations could also arise, depending on the type of coupled materials and their thicknesses, i.e. the higher the utilization temperature the more the curling diameter decreases. In this case the demonstrated behaviour may derive from the high thermal expansion capacity of polyethylene in the absence of heat-shrinkage conditions in the other plastic material (e.g. polypropylene) to which it is coupled.

With regard to the process for manufacturing the said curled ribbon, this consists of coextrusion through a usual flat-headed extruder of two plastic materials in the molten state which are compressed into it by respective screws in accordance with a known technique which enables the two plastic materials to adhere intimately together to form a film with two different layers of material (generally PP and PE).

In producing usual straight ribbons these processes use rollers to create passages and stretchings such that at the machine exit, a ribbon is obtained without any tension differences between the two superposed films, whereas in producing the spontaneous curling ribbon of the invention these same processes are modified to create passages and stretchings such that the resultant exiting ribbon presents tensions between the two films. These tensions can be achieved in various ways, but substantially derive from stabilizing the coupling between the two films such that a linear shortening difference results which is suitable to form the curling curving required in the final step of unwinding the ribbon from the reel at the predetermined utilization temperature. To understand this property of the implementing process, the following conceptual example should be considered. It will be assumed that a generic belt (comparable to films coupled together within the machine 4) has a thickness of 1 cm and passes through 180° about a cylinder of 10 centimetres diameter; that side of the belt in contact with the cylinder has a length equal to one half the circumference of the cylinder, i.e. $3.14\times10/2=15.7$ centimetres. The opposite side of this belt, being spaced from the cylinder by one centimetre, lies along a circumference of length $3.14\times(2+10/2)=18.8$ centimetres. Hence the outer side of the belt undergoes a lengthening, with respect to the inner side, of $18.8-15.7=3.1$ centimetres. If the said belt of the example passes through only 90° (instead of 180°), the difference in length would be one half, i.e. $3\frac{1}{2}=1.55$ centimetres. In this manner, by merely passing the films about cylinders they can be shortened or lengthened depending on the angle through which they pass. Depending on the thickness of the specific superposed films and the temperature at which they undergo these deviations within the machine 4, geometrical and structural modifications are achieved which can be easily used on the basis of known technical knowledge to achieve the tension differences required at the exit of the machine 4. Although there are many known methods for forming decorative ribbons, the constituent machines and plants of the individual production lines which transform the polymer into film are substantially the following: the extrusion unit; the cooler (direct or indirect, in water or not) for the state (gel or film) of the product leaving the head of the extrusion unit; the stretching unit, usually acting mainly in the longitudinal direction; and the winding machine for winding the semifinished product. The technical details obviously vary in terms of type as and number, in particular depending on the choice of the extrusion method (flat head or heads, or bubble type) and those characteristics of the final product which are to be emphasised. The primary and secondary materials typically used are: polyolefins (polypropylene, polyethylene, etc.); expanding agents (azodicarbonamides, endogenics, etc.) if a ribbon of lesser specific gravity or with different aesthetic effects is to be produced; and master batch dies (organic, etc.) or chemical additives to accentuate or modify the most various aesthetic properties of the final product. The setting-up of each production unit regards mainly its operating temperature, operating times and rates, the stretching ratios (which modify the semifinished product into film with its molecules orientated to a greater or lesser extent in the longitudinal direction compared with the transverse direction), and anything else stated in this description. To better understand the production process, an example is given hereinafter chosen from those which describe the invention using a combination of known techniques. The example given relates to the manufacture of a type of ribbon definable as "two-layer flat head coextruded with spontaneous curling".

EXAMPLE OF PRODUCTION of a two-layer coextruded ribbon formed from a layer S1 and another layer S2.

For the product layer S1 (generally transparent and without expanding agent) the basic thermoplastic material was prepared by mixing PP (the exemplifying characteristics of which are preferably high Melt Flow Index, e.g. 12: 230°; 2.16 kg; ISO 1133 g/10 min) in a quantity of about 90%, with PE (e.g. the product known by the brand name Riblene GP20, Melt Flow Index 190° C., method ASTM G1238 g/10 min: 7.5) in a quantity of about 10% (however instead of this polyolefin mixture, this layer could consist of 100% PP). The chemical swelling agent known by the brand name Genitron AC/4 of the British Company Whiffen & Sons could be added to these basic components in a quantity from 0.2 to 0.5% on the weight of the basic material. Master batch dies (for example, for orange the type 10015 of Messrs. Ferro, USA) could be added, as could other various additives (such as light mineral oil in a quantity from 0.01 to 0.03%, antioxidants (BTH Food Grade of Monsanto USA) in the same percentages, or nucleants (Irganox 1076 of Ciba-Geigy or others) in a quantity from 0.1 to 0.5% on the basic material. An extruder E1 provides the layer S1 (expanded or not) to the final product and comprises for example an extrusion screw of about 35 mm. For the other product layer S2 (generally more or less transparent depending on the quantity of expanding agent), the basic plastic material can be composed of a mixture of polyolefins PP and PE, but is generally of PE alone (both preferably as already defined in the description of the layer S1). Master batch dies can again be added to the polyolefins in a percentage corresponding to the colour intensity desired, as can the various additives already indicated for the other layer. Said layer S2 of the final product is produced by a separate extruder for example with the same screw diameter as the said extruder E1. The temperatures of the various extruder regions downstream of their hoppers vary from 200 to 225° C., being in each case that sufficient to properly activate the effect of any expanding agent present, without resulting in alteration of the materials used. The material thrust by the two extruders flows into a common typical flat-headed die with several channels (in this case two). The dimensions of said flat die correspond to the extruder diameter, for example a width of 160 mm. The die has an approximately 100 micron minimum aperture. In this manner there emerges from the die a flat spongy element with a thickness varying from 250 to 500 micron, depending on its required thickness on the final product. The element, whether spongy or not, is immediately cooled. If cooling in a water bath is chosen (instead of in air, chill-roll or with cooling rollers) the liquid temperature should be maintained preferably between 15 and 45° C. Said cooled flat element is dragged by a usual pair of conveying rollers. For the subsequent units of the production line the temperatures at which the material is stretched must be regulated according to the chosen type of stretching and according to the characteristics to be conferred on the final product in accordance with the proper technology of the art. For stretching using heated cylinders, for example by thermal oil, this oil must maintain a constant temperature compatible and suitable for each product surface directly in contact with the cylinders, of between 40 and 120° C. In said operating unit the stretching ratios can vary from about 1:3 to about 1:5, the ratio being however a function of the appearance and utilization characteristics of the final product. For the example described herein, in the product stabilization station the optimum temperature can be about 100° C., to then gradually decrease until the product reaches ambient temperature for its final winding. The ratio in the stabilization station is from 1 to 0.97.

The invention claimed is:

1. A process for forming a curled decorative ribbon, comprising the steps of:

co-extruding in the molten state to adhere intimately together at least a first and a second plastic layers having different physical properties;

adding an expanding agent to at least one of the first and second plastic layers before the co-extruding step;

stretching said first and second layers that are adhered intimately together;

cooling said first and second layers that have been stretched to form a ribbon; and winding said ribbon on a reel so that said ribbon has curls therein when said ribbon is unwound from the reel.

2. The process as claimed in claim 1, wherein the physical properties comprise mechanical and/or thermal properties.

3. The process as claimed in claim 1, wherein the first and second layers are formed of polyolefin plastic.

4. The process of claim 1, wherein the expanding agent is added to only one of the first and second plastic layers and is azodicarbonamide.

5. The process of claim 1, wherein the first plastic layer is polypropylene and the second plastic layer, is polyethylene.

6. The process of claim 1, wherein the cooling step comprises the steps of immediately cooling the ribbon and then stretching the cooled ribbon at a temperature in the range of 40° C. to 120° C., wherein a stretching ratio is from about 1:3 to about 1:5.

7. A process for forming a curled decorative ribbon, the ribbon having first and second plastic layers having different elongations under traction, the method comprising the steps of:

selecting first and second temperatures having a temperature difference, wherein the temperature difference defines a curling radius of the ribbon and increasing the temperature difference decreases the curling radius;

co-extruding the first and second plastic layers at the first temperature, the first and second plastic layers being adhered intimately together and forcibly maintained straight during formation thereof;

adding an expanding agent to at least one of the first and second plastic layers before the co-extruding step;

forcibly maintaining the first and second plastic layers straight after the co-extruding step;

cooling the first and second plastic layers to the second temperature to form a decorative ribbon that, in use, has the curling radius determined by the temperature difference; and winding the decorative ribbon on a reel that has a radius larger than the curling radius.

8. The process of claim 7, wherein the expanding agent is added to only one of the first and second plastic layers and is azodicarbonamide.

9. The process of claim 7, wherein the first plastic layer is polypropylene and the second plastic layer is polyethylene.

10. The process of claim 7, wherein the cooling step comprises the steps of immediately cooling the ribbon to the second temperature and then stretching the cooled ribbon at a temperature in the range of 40° C. to 120° C., wherein a stretching ratio is from about 1:3 to about 1:5.

* * * * *